US008360044B2

(12) United States Patent
Platt

(10) Patent No.: US 8,360,044 B2
(45) Date of Patent: Jan. 29, 2013

(54) STRUCTURE AND METHOD FOR STABILIZING AN ARCHERS HAND

(76) Inventor: David C. Platt, Morrison, CO (US)

( * ) Notice: Subject to any disclaimer, the term of this patent is extended or adjusted under 35 U.S.C. 154(b) by 80 days.

(21) Appl. No.: 13/098,478

(22) Filed: May 1, 2011

(65) Prior Publication Data

US 2011/0203563 A1 Aug. 25, 2011

Related U.S. Application Data

(63) Continuation-in-part of application No. 11/933,330, filed on Oct. 31, 2007, now Pat. No. 7,954,175.

(60) Provisional application No. 60/877,067, filed on Jan. 29, 2007.

(51) Int. Cl.
*F41B 5/14* (2006.01)
*F41B 5/16* (2006.01)

(52) U.S. Cl. ..... 124/88; 124/1; 124/23.1; 124/86

(58) Field of Classification Search ..... 124/1, 23.1, 124/86, 88
See application file for complete search history.

(56) References Cited

U.S. PATENT DOCUMENTS 3,572,312 A * 3/1971 Foster ..... 124/23.1
3,599,621 A * 8/1971 Scrobell ..... 124/23.1
4,343,286 A * 8/1982 Thacker ..... 124/24.1
4,457,287 A * 7/1984 Babington ..... 124/23.1
4,714,071 A * 12/1987 Saunders ..... 124/88
4,777,666 A * 10/1988 Beverlin ..... 2/161.5
4,836,177 A * 6/1989 Williams ..... 124/89
4,881,514 A * 11/1989 Denslow et al. ..... 124/88
4,976,250 A * 12/1990 Jeffrey ..... 124/25
5,009,216 A * 4/1991 Ross ..... 124/88
5,070,856 A * 12/1991 Plummer ..... 124/88
5,110,154 A * 5/1992 Street ..... 280/822
5,113,841 A * 5/1992 Bratcher ..... 124/23.1
5,277,170 A * 1/1994 Carella ..... 124/86
5,323,754 A * 6/1994 Pittman et al. ..... 124/35.2
5,531,211 A * 7/1996 Wilfong, Jr. ..... 124/86
5,617,838 A * 4/1997 Peruski ..... 124/88
5,853,000 A * 12/1998 Torgerson et al. ..... 124/88
5,887,282 A * 3/1999 Lenhart ..... 2/159
5,988,681 A * 11/1999 Vesalainen et al. ..... 280/821
6,173,707 B1 * 1/2001 Howell et al. ..... 124/88
6,233,743 B1 * 5/2001 Cummins ..... 2/160
6,386,588 B1 * 5/2002 Young et al. ..... 280/821
6,460,891 B1 * 10/2002 Jones ..... 280/821
6,536,050 B1 * 3/2003 Hill ..... 2/161.6
6,637,773 B1 * 10/2003 Trinen et al. ..... 280/821
6,755,440 B1 * 6/2004 Jones ..... 280/822
6,898,804 B2 * 5/2005 Sandler ..... 2/161.1
7,066,165 B2 * 6/2006 Perry ..... 124/23.1
7,124,536 B2 * 10/2006 Harkey ..... 43/21.2
7,475,433 B2 * 1/2009 Coulter et al. ..... 2/160
7,638,699 B2 * 12/2009 Buettgen ..... 84/387 A
7,708,004 B2 * 5/2010 Moss et al. ..... 124/88
7,954,175 B2 * 6/2011 Platt ..... 2/161.5

(Continued)

*Primary Examiner* — Gene Kim
*Assistant Examiner* — Alexander Niconovich
(74) *Attorney, Agent, or Firm* — Roger A. Jackson

(57) ABSTRACT

An archer's hand support structure apparatus and method of use is disclosed to help stabilize an archer's hand during string draw and string release of an archer's bow. The archer's hand support structure apparatus includes an archer's bow that has a handle portion and a rigid member that is affixed to the handle portion, the rigid member is constructed of substantially non-pliant material adapted to encase the archer's hand, the rigid member having a finger aperture portion extending adjacent to an archer's distal hand portion and a wrist aperture portion extending adjacent to an archer's proximal hand portion. The rigid member also includes an expansion slot therethrough disposed substantially adjacent to the wrist aperture portion to temporarily expand the wrist aperture portion for operationally accommodating an archer's fingers communication from the wrist aperture to the finger aperture.

4 Claims, 12 Drawing Sheets

U.S. PATENT DOCUMENTS

2003/0070669 A1* 4/2003 Beville ..... 124/88
2006/0174395 A1* 8/2006 Mayo ..... 2/160
2007/0022512 A1* 2/2007 Coulter et al. ..... 2/161.1
2009/0293702 A1* 12/2009 Buettgen ..... 84/387 A

* cited by examiner

STRUCTURE AND METHOD FOR STABILIZING AN ARCHERS HAND

RELATED PATENT APPLICATIONS

This continuation in part (CIP) patent application claims priority from U.S. non-provisional utility patent application Ser. No. 11/933,330 filed on Oct. 31, 2007 now U.S. Pat. No. 7,954,175 by David Platt of Morrison, Colo. and original priority from U.S. provisional patent application Ser. No. 60/887,067 filed Jan. 29, 2007 by David Platt of Morrison, Colo.

FIELD AND BACKGROUND

The present invention broadly relates to the sport of archery. More particularly, the exemplary embodiments of this invention are directed to assist in stabilizing the hand position of an archer on the handle of a bow while shooting. Thus, the present invention may be used, for example, by an archer when target shooting or hunting. As such, the embodiments of the present invention function to stabilize the bow body relative to the hand or arm of the archer to reduce undesirable movement during bow string draw and release thus resulting in a desirable improvement in bow shooting accuracy.

As it is known, many archery bows have a relatively high draw weight (the rearward string force) required to flex the bow body to its fully drawn position, being done to give the bow's arrow more range distance wise and more piercing force at a further distance. When this occurs, the bow body undergoes various torques or moments that are particularly present at the location of the archer's hand that is, at the handle or grip of the bow as being the quasi pivotal support point for the bow to react through, both during pull back and release of the bow string. For example, some of these moments tend to rotate the bow handle toward the palm side of the archer's hand about a vertical axis. Other moments tend to tip the upper bow limb toward the archer about a horizontal axis. Each or the combination of these moments may affect the flight accuracy of the arrow and therefore the accuracy of that archer. Moreover, they can strain or fatigue the bow holding hand or have the archer compensating for the previously described moments by attempting to manually create opposing moments in the hand, wrist, or forearm that can further add to arrow inaccuracy due to the variable moment compensation levels of the archer.

Various apparatus have been developed in an effort to more accurately compensate for these aforementioned undesirable moments at the bow handle that are recognized in the prior art. For example, various bow to arm, wrist, or hand structural supports have been proposed to attach to the bow in order to partially support the arm, wrist, or hand of the archer as against the aforementioned moments.

In other efforts to reduce the effect of the previously described bow moments, some archers opt to hold the bow handle loosely with the fingers and thumb projecting forwardly of the handle with the bow handle being received in the space between the thumb and index finger. Since the bow handle is not gripped tightly, the also aforementioned manual compensatory moments, sometimes termed the after shoot jerk; to resist the bow induced moments are substantially eliminated by the loose grip from the archer's hand to the bow. However, this type of bow grip is not natural and many archers tend to grip the bow handle very tightly as an instinctual reaction when shooting. As a result, the moment forces are applied to the wrist of the archer which can affect the accuracy of the arrow's flight as previously discussed.

Another problem is encountered by archers when they are stalking the prey; the archer typically carries the bow by its handle. Because the bow is gripped, the hand and fingers of the archer can become unduly fatigued or tired over time from simply carrying the bow for extended periods of time, especially when transversing rough terrain. Since the bow hunting activity typically occurs over a significant interval of time, the hand may cramp or otherwise become excessively tired resulting in the accuracy of the bow hunter being diminished when game is finally sighted. Moreover, when hunting in a cold climate, the hand may be more exposed to the environment and bow gripping ability and feel reduced by carrying of the bow by the hand.

Further as previously stated, this issue has been recognized in the prior art, starting with apparatus that operate to brace a portion of the archer's hand, wrist, or forearm, thus in looking at U.S. Pat. No. 4,836,177 to Williams disclosed is an archery bow wrist brace apparatus that uses a "U" shaped loop of rigid material that has a padded outer surface, wherein the free ends of the "U" affix to the bow handle and the semi-circular portion of the "U" rests against the user's forearm. In Williams, the purpose being to strengthen the user's wrist in resisting the moment at the bow handle from bow string pull and release by transferring a vertical moment and a horizontal moment between the user's wrist and the bow handle to the user's forearm for strength and stability. However, with Williams having the drawback of a higher surface area unit loading on the archer's forearm due to the smaller diameter band that is in the "U" shape, potentially causing forearm fatigue and pain for the archer.

Further in this area in U.S. Pat. No. 5,853,001 to Vypracht-icky disclosed in an archery bow handgrip that appears similar to a pistol grip with an open conic portion that is adjacent to the archer's forearm that is operable to brace the wrist and forearm to one another, however, with the drawback of the size bulkiness of the pistol grip and conic portion combination structurally. Further, in this same area of structural braces adjacent to a portion of an archer's hand in U.S. Pat. No. 5,853,000 to Torgerson et al., disclosed is an archer's wrist brace in the shape of an "L" that is pivotally adjustable at the bow handle. In Torgerson et al., the "L" portion short extension braces against the archer's arm for stability and to help prevent the archer's arm from getting in the path of the bow string. Torgerson et al., has the same problem as Williams in that there is a higher surface area unit loading as against the archer's arm from the relatively small diameter brace, again potentially causing forearm fatigue and pain for the archer.

Continuing, in this area in U.S. Pat. No. 5,617,838 to Peruski disclosed is an archery aid that is structured to be a form for configuring an archer's hand in a flat open shape with only the thumb and index finger forming a cupped shape around a portion of the bow handle, this is beneficial in some archer's minds as hard hand gripping of a bow is attributable to reduce aim accuracy when the arrow is released as the closed hard grip of the hand on the bow handle causes a reactive "jerk" due to the changing forces surrounding the bow handle at arrow release. In Peruski this is due to the archer's wrist resisting an upward and lateral moment at bow string drawback, wherein at string release this upward and lateral moment are suddenly reduced wherein the archer's wrist instantly reacts oppositely from the above mentioned preloading moments at bow string drawback, thereby affecting arrow aim accuracy. Even though Peruski is a partial solution to this line of archery accuracy thinking, there is the added drawback of increasing difficulty in holding and carrying the bow during non arrow shooting periods.

Another prior art approach is in using a special glove that is affixed to the archer's hand that has some stiffening and supportive capabilities that assist the archer's hand, wrist, and forearm. Starting with U.S. Pat. No. 5,070,856 to Plummer disclosed is a hand/bow interface that provides a low friction interface between the archer's hand and the bow handle for the purpose of reducing the effect of the aforementioned "jerk" in Peruski above by lessening the effect of archer involuntary wrist and hand movement into the bow, thus reducing arrow inaccuracy from this archer hand and wrist movement. Plummer has the drawback of still allowing the high string pullback upward and lateral moments at the bow handle being resisted by the archer's hand and wrist that can affect initial arrow aim accuracy.

Further, in this area in United States patent application publication number US 2007/0022512 A1 to Coulter et al., disclosed is a glove with stiffeners primarily for weightlifting and adding stiffening in the area of the back of the hand while leaving the finger tips free for dexterity, while not specific to archery, Coulter et al., does teach a hand glove with stiffener elements. Also, in the hand stiffening glove arts in U.S. Pat. No. 4,138,108 to Robinson, disclosed is a wrist stiffening bowlers glove, bracing primarily between the palm and forearm while desirably leaving the fingers and the thumb free for grasping the bowling ball, while helping to prevent forwards or backwards flexing of the wrist, being somewhat similar to Coulter et al., in having specialized stiffening for a particular application.

Also, in looking at United States patent application publication number US 2006/0174395 A1 to Mayo disclosed is a glove with special attachments for helping to hold weights such as dumb bells, wherein a removably engagable interface exists between the glove palm and the dumb bell grasping area, whereas various means for the removable engagement are disclosed. Further in this area, in U.S. Pat. No. 6,755,440 B1 to Jones disclosed is a snow skiing pole handle to ski glove removable engagement used in conjunction with a special skiing pole handle that pivots in relation to the pole portion of the ski pole to lessen the effect of the attachment between the glove and the handle by adding more flexibility to the hand and handle interface, wherein the attachment is a protrusion that is received into a matching concavity. Continuing, in U.S. Pat. No. 6,898,804 B2 to Sandler disclosed is another ski type glove for attachment to a ski pole handle utilizing a hook and loop fastener between the glove palm and the ski pole handle.

Accordingly, there is a need to provide additional structural features to the hand/bow interface for improving the grip of an archer on the handle of a bow that ultimately results in improved arrow accuracy. There is a further need for apparatus in the hand/bow interface that can help stabilize the hand of the archer as against the various previously described moment forces that result during the increasingly heavy string draw and release of the bow. Further, there is a need for apparatus which can easily and effectively allow the archer to carry the bow during intervals of non use with minimal fatigue especially on the archer's hand, wrist, and arm, wherein the present invention is directed to meeting these needs.

SUMMARY

Broadly, the present invention is an archer's hand support structure apparatus and method of use is to help stabilize an archer's hand during string draw and string release of an archer's bow. The archer's hand support structure apparatus includes an archer's bow that has a handle portion and a rigid member that is affixed to the handle portion, the rigid member is constructed of substantially non-pliant material adapted to encase the archer's hand, the rigid member having a finger aperture portion extending adjacent to an archer's distal hand portion and a wrist aperture portion extending adjacent to an archer's proximal hand portion. The rigid member also includes an expansion slot therethrough disposed substantially adjacent to the wrist aperture portion to temporarily expand the wrist aperture portion for operationally accommodating an archer's fingers communication from the wrist aperture to the finger aperture.

REFERENCE ELEMENT NUMBERS

Figure 1:
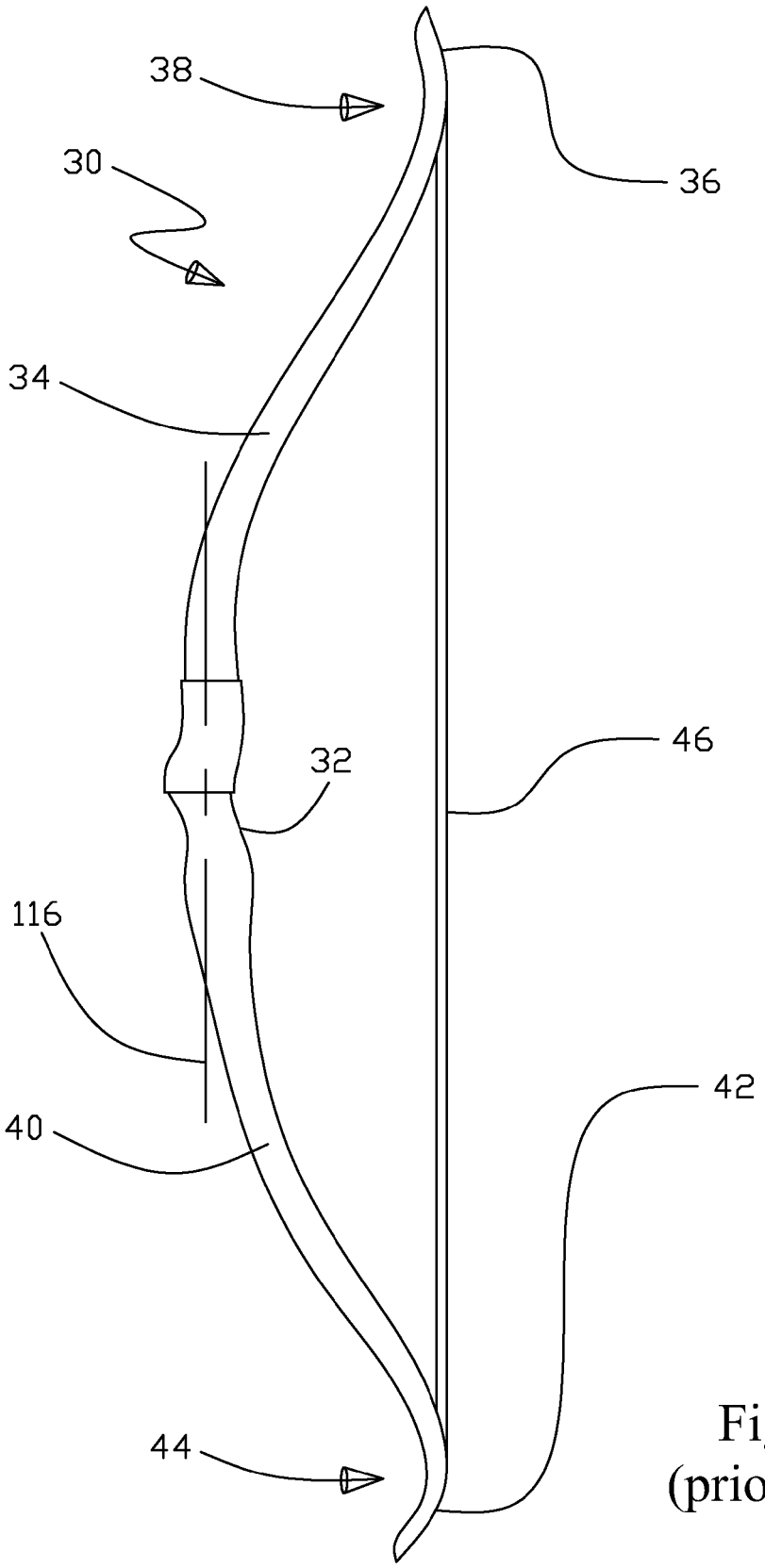
Fig.1 (prior art)
FIG. 1 is a side view and elevation of an exemplary recurve bow according to the prior art.

30 Bow apparatus as embodied in the prior art
32 Grip or handle of bow apparatus 30
34 First limb of bow apparatus 30
36 First tip of bow apparatus 30
38 First recurve of bow apparatus 30
40 Second limb of bow apparatus 30
42 Second tip of bow apparatus 30
44 Second recurve of bow apparatus 30
46 Bow string of bow apparatus 30
50 Compound bow as embodied in the prior art
52 Grip or handle of compound bow 50
54 First rigid arm portion of compound bow 50
56 Second rigid arm portion of compound bow 50
58 First limb of compound bow 50
60 First distal tip of compound bow 50
62 First wheel of compound bow 50
64 Second limb of compound bow 50
66 Second distal tip of compound bow 50
68 Cam of compound bow 50
70 Cable and bowstring combination of compound bow 50
80 Prior art glove of archer
81 Archer
82 Hand of archer
83 Archer's thumb
84 Main body panel of prior art archer glove 80
85 Archer's arm proximal portion
86 First attachment straps of prior art archer glove 80
87 Archer's fingers or archer's distal hand portion
88 Gap between straps 86 of prior art archer glove 80
90 Second attachment strap of prior art archer glove 80
92 Side edge of prior art archer glove 80
94 Elongated oval opening of prior art archer glove 80
96 Strip of loop elements of prior art archer glove 80
98 Strip of filaform element mounted on the distal end of strap 86 of prior art archer glove 80
100 Strip of filaform element mounted on the end of distal strap 90 of prior art archer glove 80
102 First rigid support of prior art archer glove 80
104 Pocket of first rigid support 102 of prior art archer glove 80
106 Second rigid support of prior art archer glove 80
108 Pocket of second rigid support 106 of prior art archer glove 80
110 Distal hand portion of archer 81
112 Proximal hand portion of archer 81
114 Lengthwise axis of archer's 81 hand 82
116 Longwise axis of bow 30 or 50
117 Rigid member
118 Higher lateral stiffness direction of rigid member 117
120 Lower lateral stiffness direction of rigid member 117
122 Finger apertures portion
125 Expansion slot
126 Movement of expansion slot 125 expanding the wrist aperture portion 162
160 Archer's hand support structure apparatus of a first exemplary embodiment
161 Retention strap
162 Wrist aperture portion
163 Flex relief aperture
260 Second exemplary embodiment of the archer's hand support structure apparatus
262 Structural extension member
400 Draw force of bow 30 or 50
402 Vertical moment arm of bow 30 or 50
404 Vertical moment of bow 30 or 50
410 Horizontal moment arm of bow 30 or 50
412 Horizontal moment of bow 30 or 50

DETAILED DESCRIPTION OF THE EXEMPLARY EMBODIMENTS

The present invention broadly relates to auxiliary aids for archers when shooting an arrow from a bow, for example, when target shooting, hunting, and the like. More specifically, the exemplary embodiments described herein are directed to mechanically linking or nesting the handle or grip of a bow to an archery glove worn by an archer in order to provide a greater stability while shooting an arrow from the bow and while carrying the bow while seeking prey. It should be appreciated that the exemplary embodiments of the present invention are modifications to existing prior art apparatus. As such, these exemplary embodiments may be manufactured as original equipment or, in some instances, retrofitted onto an existing bow handle.

In order to understand the exemplary embodiments of the present invention, it is thus helpful to understand the structure of common types of bows. A first exemplary embodiment of a prior art bow is illustrated in FIG. 1. Here, bow 30 is in the form of a recurve bow and includes a grip or handle 32. A first limb 34 projects upwardly (when in a shooting position) to terminate in a first tip 36. First limb 34 is provided with a first recurve 38, and is known in the art. A second limb 40 projects downwardly (when in a shooting position) from handle 32 to terminate in a second tip 42 with the second limb 40 again being provided with a second recurve 44. A bow string 46 then extends between a first tip 36 and a second tip 42 and is maintained under tension by first and second limbs 34 and 40.

Figure 2:
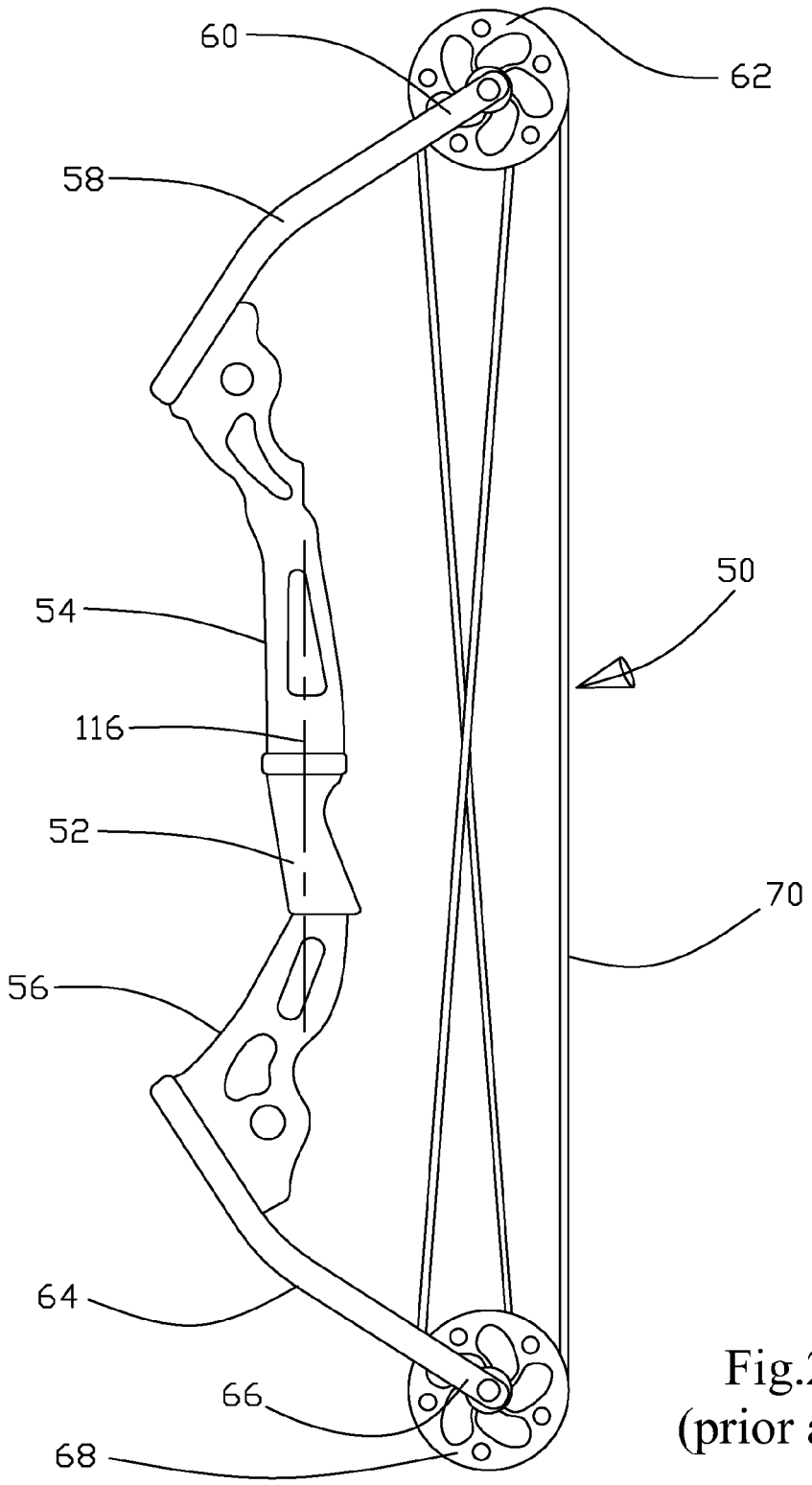
Fig.2 (prior art)
FIG. 2 is a side view and elevation of an exemplary compound bow according to the prior art.

Another type of bow well known in the prior art is known as a "compound bow." An exemplary embodiment of the compound bow 50 is illustrated in FIG. 2. Bow 50 again has a grip or handle 52 from which projects first and second rigid arm portions 54 and 56. A flexible, resilient first limb 58 has its proximal first end secured to the distal end of first arm portion 54 and terminates in a distal first tip 60 that rotatably supports a wheel 62. Similarly, a second limb 64 has its proximal end secured to the distal end of second arm portion 56 and terminates in a distal second tip 66 that rotatably supports a cam 68. Cam 68 and wheel 62 are mechanically linked by a cable and bowstring combination 70.

When using a bow, many archers desire to use an archer's glove that supports the hand and wrist of the archer during shooting activity. An exemplary embodiment of such a prior art archer's glove 80 is introduced in FIG. 3 wherein glove 80 is illustrated in a mounted state on hand 82 of the archer 81. FIGS. 4 and 5 illustrate glove 80 in an opened, flattened state prior to mounting on the hand 82. With respect to these Figures, FIG. 4 illustrates the exterior side of glove 80, when worn, and FIG. 5 illustrates the interior side of glove 80 (when being worn).

Figure 3:
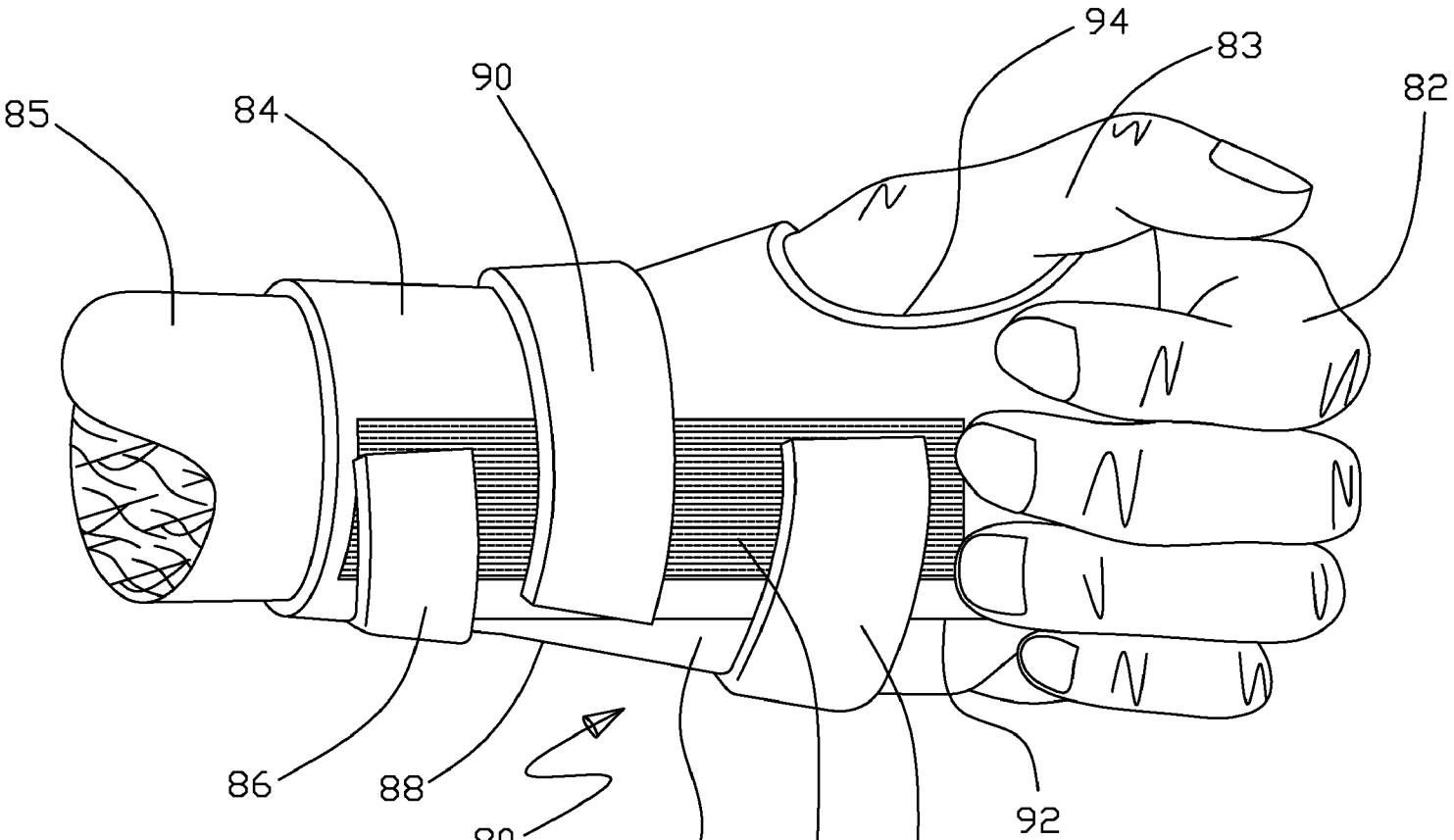
Fig.3 (prior art)
FIG. 3 is a perspective view of an archer's glove apparatus according to an exemplary embodiment of the prior art and in a mounted state on an archer's hand.
Figure 4:
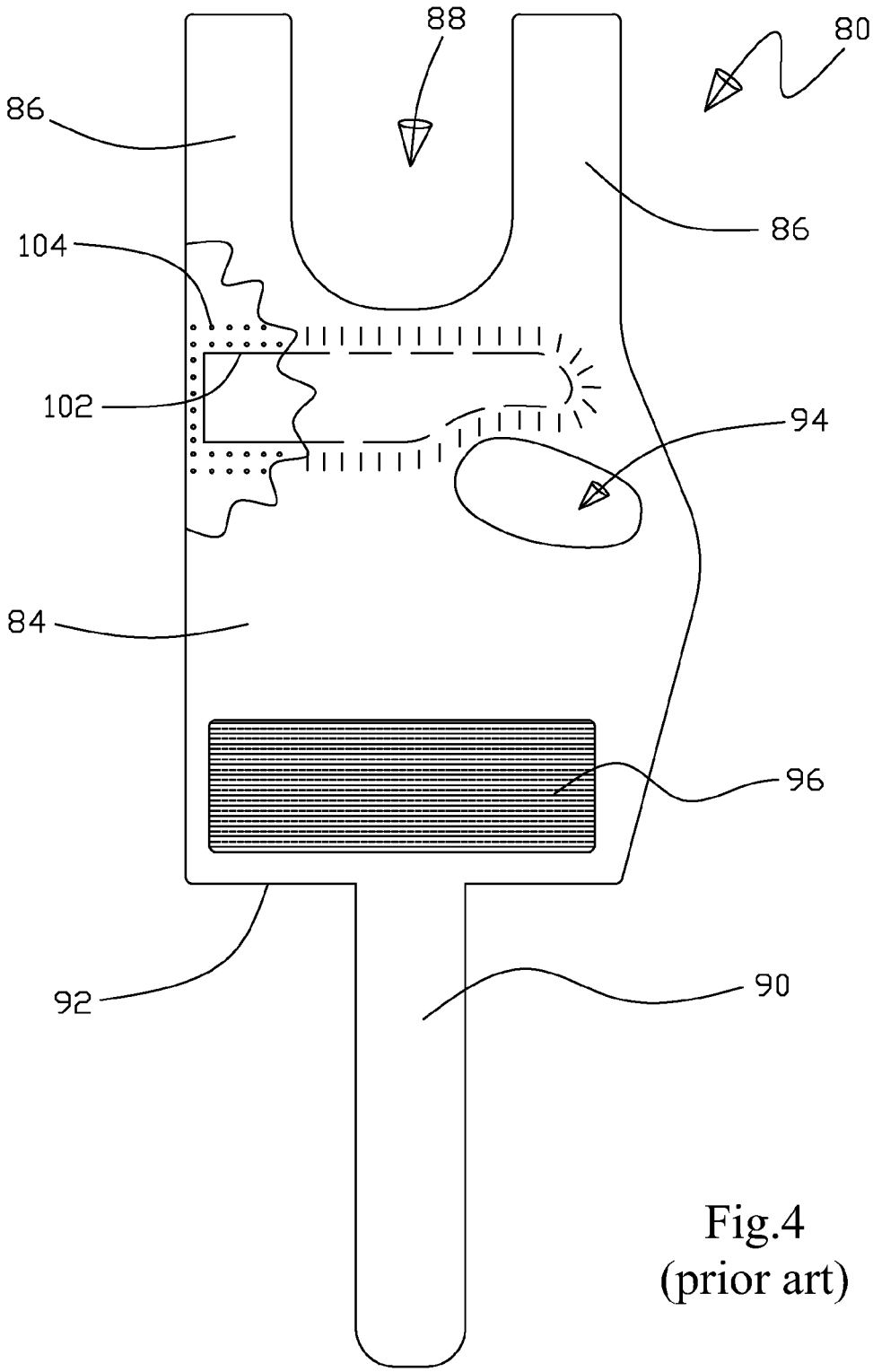
Fig.4 (prior art)
FIG. 4 is a plan view of the archer's glove of FIG. 3 in an open, unwrapped flat state with the glove being viewed from the external side that is worn away from the archers hand.
Figure 5:
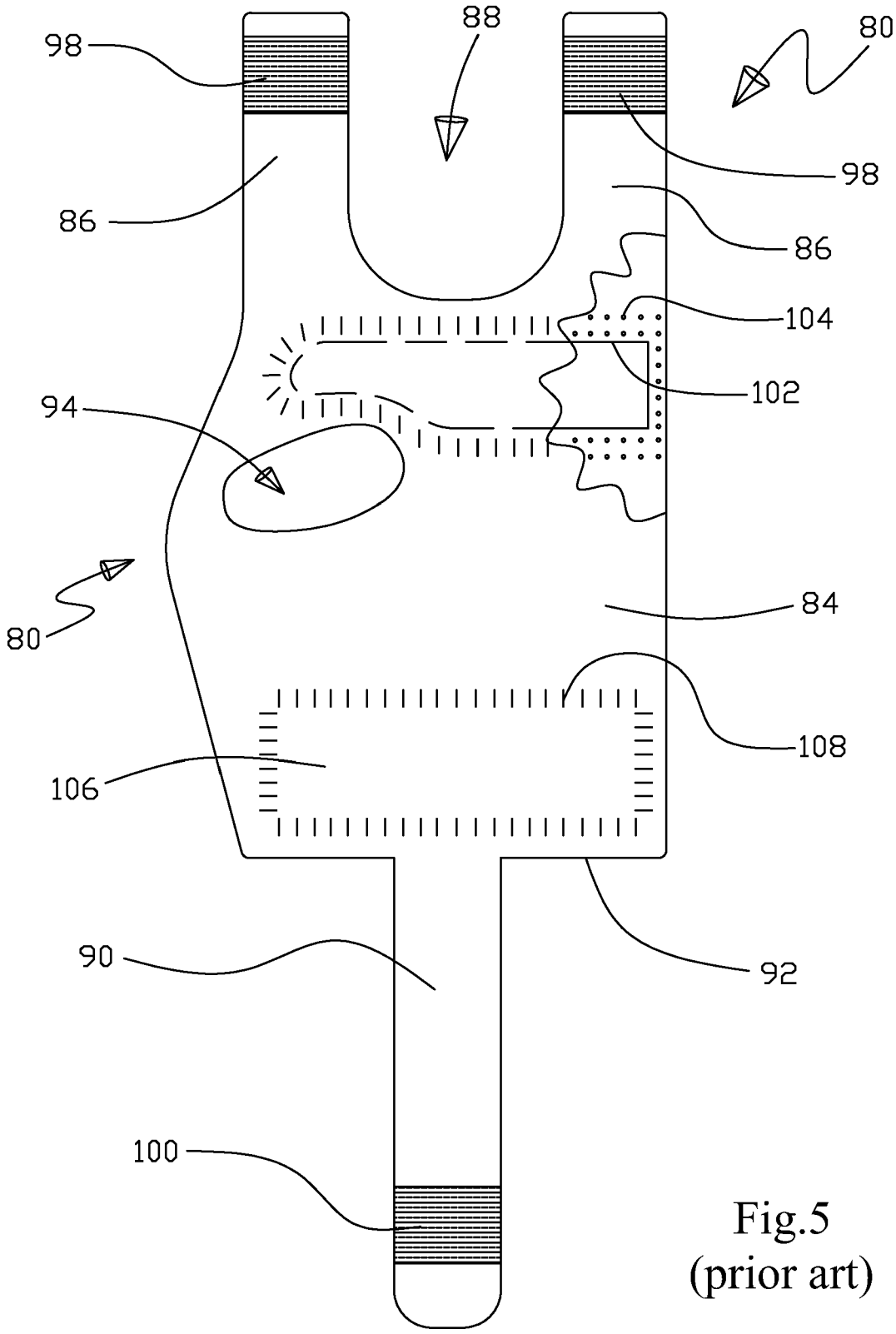
Fig.5 (prior art)
FIG. 5 is a plan view similar to FIG. 4, however, showing the archers glove of FIG. 3 viewed from the inside showing the surface that is against the archers hand when in the mounted state.

With respect to FIGS. 3-5, it may be appreciated that glove 80 includes a main body panel 84 that is adapted to extend around the user's wrist and hand 82. A pair of first attachment straps 86 project on one side of main body panel 84 in a spaced, parallel relation to one another. A gap 88 is therefore formed between straps 86. A second attachment strap 90 projects on an opposite side of main body panel 84 medially of a side edge 92 thereof.

Typically, archer gloves are secured around the hand of the wearer by mating hooking loop fastening members. Thus, as is illustrated in FIG. 4, a strip 96 of loop elements is located proximately to edge 92 and parallel thereto. As is illustrated in FIG. 5, strips 98 of filaform elements are mounted on the distal ends of straps 86 and a strip 100 of filaform elements are mounted on the distal end of attachment strap 90. Thus, when mounted, the pair of straps 86 and attachment strap 90 may wrap around the wrist and hand 82 of the archer 81 with filaform strips 98 and 100 adjustably engaging loop strip 96. As may be seen, the distal end of attachment strap 90 resides in gap 88 when the glove 80 is in a mounted state.

With continued reference to FIGS. 4 and 5, it may seem that an elongated oval opening 94 is formed in main body panel 84 to accommodate the thumb 83 of the archer, as is illustrated in FIG. 3. It may also be appreciated that some archery gloves include rigid support pieces to further stabilize the archer's hand. Thus as is shown in phantom in these figures, a first rigid support 102 is sewn into a pocket 104 and a second rigid support 106 may be sewn into pocket 108 into main body panel 84 parallel to edge 92. For example, rigid support 106 may be generally congruent with filaform strip 96.

With the above structures in mind, the exemplary embodiments of the present invention may be better understood. Broadly, the present invention as shown in FIG. 6 is the side view in elevation of the handle portion 32, 52 respectively of the bow apparatus 30 or the compound bow 50 of FIGS. 1 and 2 illustrating a first exemplary embodiment 160 of the present invention with the rigid member 117 that includes the retention strap 161, the wrist aperture 162, the finger apertures 122, the expansion slot 125, the flex relief aperture 163, and the higher 118 and lower 120 stiffness directions of the rigid member 117, wherein the rigid member 117 is integral with the bow handle 32, 52 forming the first exemplary embodiment 160 of the present invention.

Figure 6:
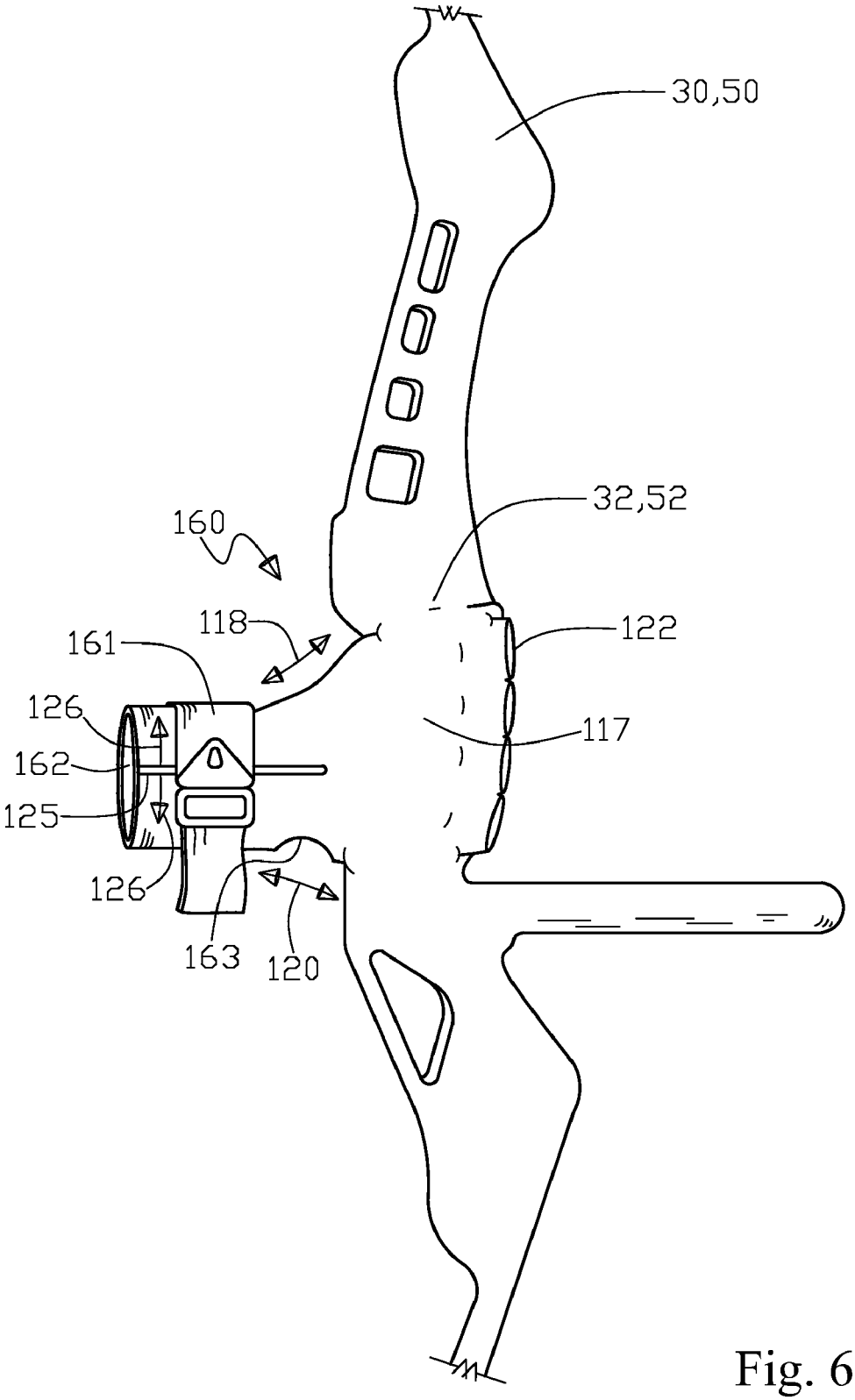
FIG. 6 is a side view in elevation of the handle portion of the bow apparatus or the compound bow of FIGS. 1 and 2 illustrating a first exemplary embodiment of the present invention with the rigid member that includes the retention strap, the wrist aperture, the finger apertures, the expansion slot, the flex relief aperture, and the higher and lower stiffness directions of the rigid member, wherein the rigid member is integral with the bow handle forming the first exemplary embodiment of the present invention.
Figure 7:
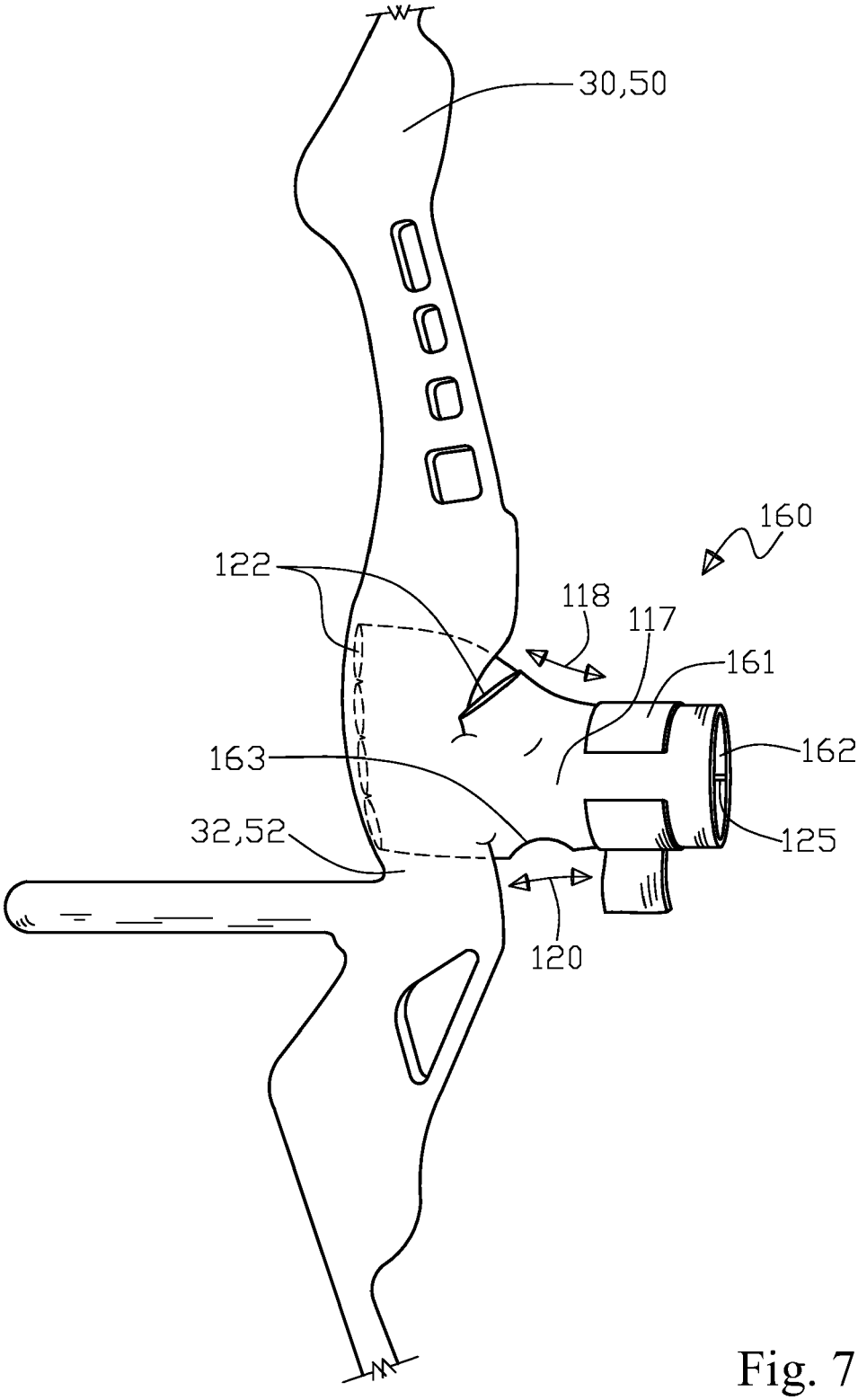
FIG. 7 is an opposing side view in elevation from FIG. 6 of the handle portion of the bow apparatus or the compound bow of FIGS. 1 and 2 illustrating a first exemplary embodiment of the present invention with the rigid member that includes the retention strap, the wrist aperture, the finger apertures, the expansion slot, the flex relief aperture, and the higher and lower stiffness directions of the rigid member, wherein the rigid member is integral with the bow handle forming the first exemplary embodiment of the present invention.

Continuing, FIG. 7 is an opposing side view in elevation from FIG. 6 of the handle portion 32, 52 respectively of the bow apparatus 30 or the compound bow 50 of FIGS. 1 and 2 illustrating a first exemplary embodiment 160 of the present invention with the rigid member 117 that includes the retention strap 161, the wrist aperture 162, the finger apertures 122, the expansion slot 125, the flex relief aperture 163, and the higher 118 and lower 120 stiffness directions of the rigid member 117, wherein the rigid member 117 is integral with the bow handle 32, 52 forming the first exemplary embodiment 160 of the present invention.

Figure 8:
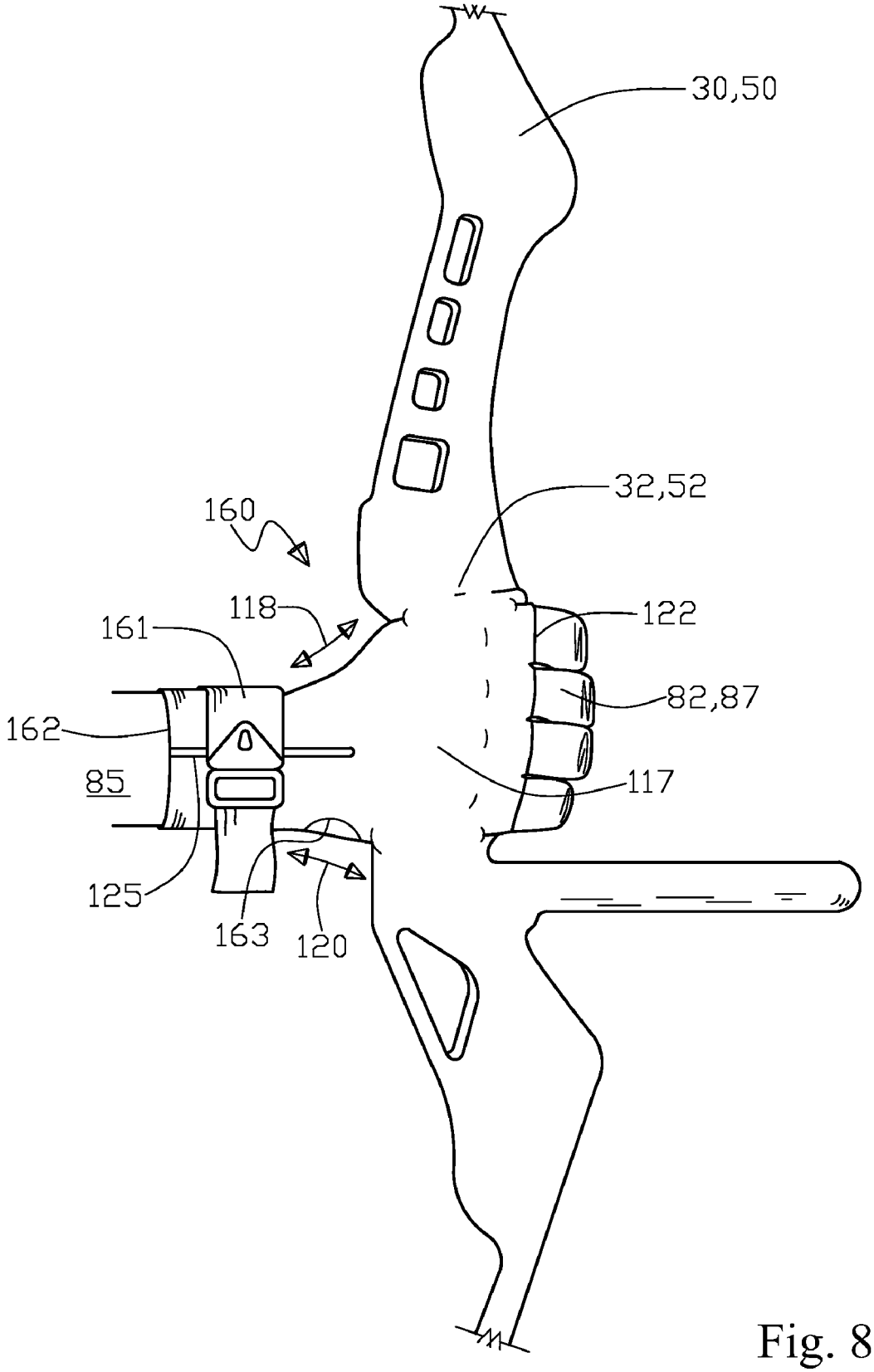
FIG. 8 is a use side view in elevation of the handle portion of the bow apparatus or the compound bow of FIGS. 1 and 2 illustrating a first exemplary embodiment of the present invention with the archers hand, thumb, fingers, and arm inserted into the rigid member that includes the retention strap, the wrist aperture, the finger apertures, the expansion slot, the flex relief aperture, and the higher and lower stiffness directions of the rigid member, wherein the rigid member is integral with the bow handle forming the first exemplary embodiment of the present invention.

Further, FIG. 8 is a use side view in elevation of the handle portion 32, 52 respectively of the bow apparatus 30 or the compound bow 50 of FIGS. 1 and 2 illustrating a first exemplary embodiment 160 of the present invention with the archers 81 hand 82, thumb 83, fingers 87, and arm 85 inserted into the rigid member 117. Wherein the rigid member 117 includes the retention strap 161, the wrist aperture 162, the finger apertures 122, the expansion slot 125, the flex relief aperture 163, and the higher 118 and lower 120 stiffness directions of the rigid member 117, wherein the rigid member 117 is integral with the bow handle 32, 52 forming the first exemplary embodiment 160 of the present invention.

Figure 9:
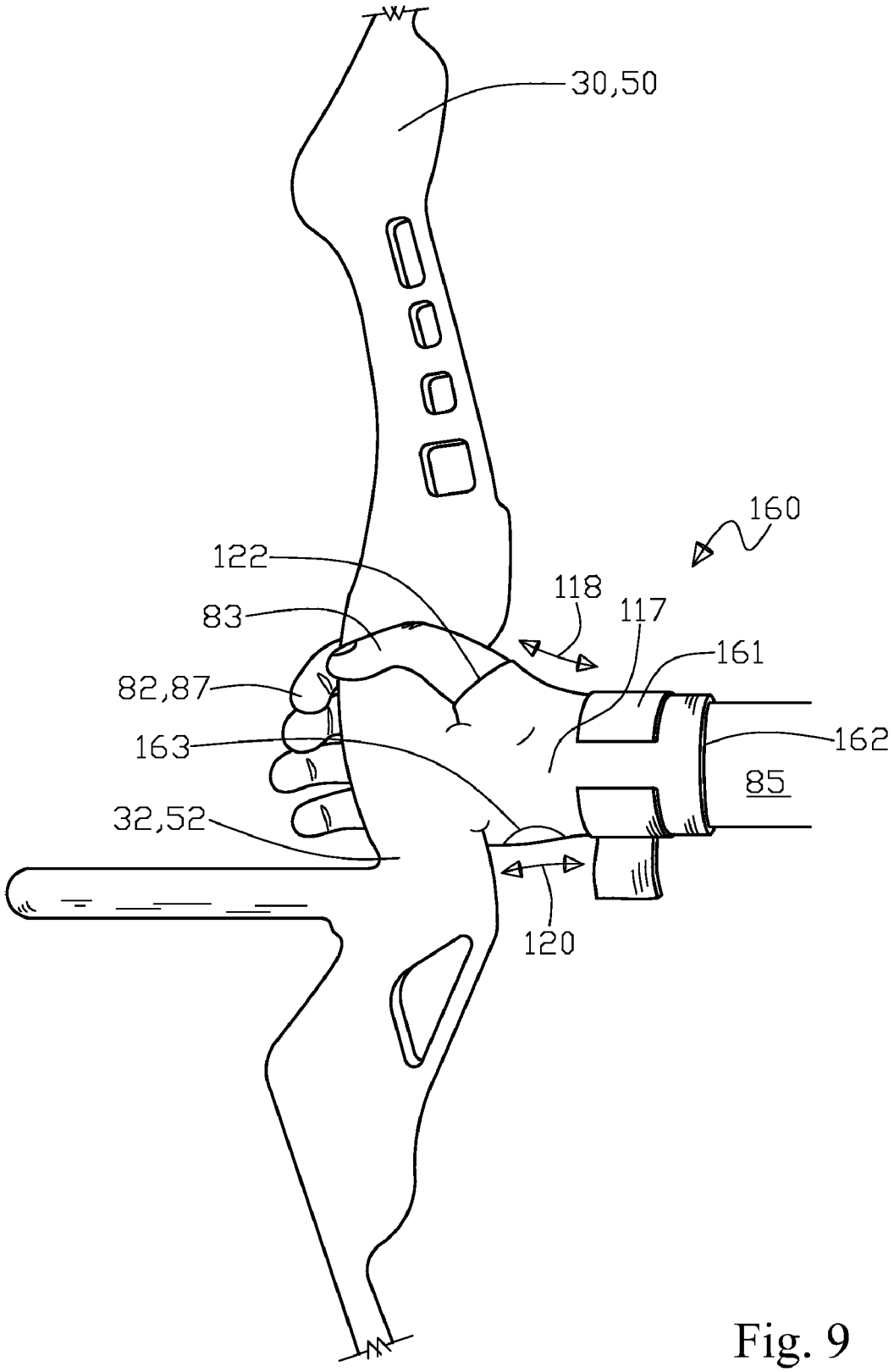
FIG. 9 is an opposing use side view in relation to FIG. 8 shown in elevation of the handle portion of the bow apparatus or the compound bow of FIGS. 1 and 2 illustrating a first exemplary embodiment of the present invention with the archers hand, thumb, fingers, and arm inserted into the rigid member that includes the retention strap, the wrist aperture, the finger apertures, the expansion slot, the flex relief aperture, and the higher and lower stiffness directions of the rigid member, wherein the rigid member is integral with the bow handle forming the first exemplary embodiment of the present invention.

Next, FIG. 9 is an opposing use side view in relation to FIG. 8 shown in elevation of the handle portion 32, 52 respectively of the bow apparatus 30 or the compound bow 50 of FIGS. 1 and 2 illustrating a first exemplary embodiment 160 of the present invention with the archers 81 hand 82, thumb 83, fingers 87, and arm 85 inserted into the rigid member 117 that includes the retention strap 161, the wrist aperture 162, the finger apertures 122, the expansion slot 125, the flex relief aperture 163, and the higher 118 and lower 120 stiffness directions of the rigid member 117, wherein the rigid member 117 is integral with the bow handle 32, 52 forming the first exemplary embodiment 160 of the present invention.

Figure 10:
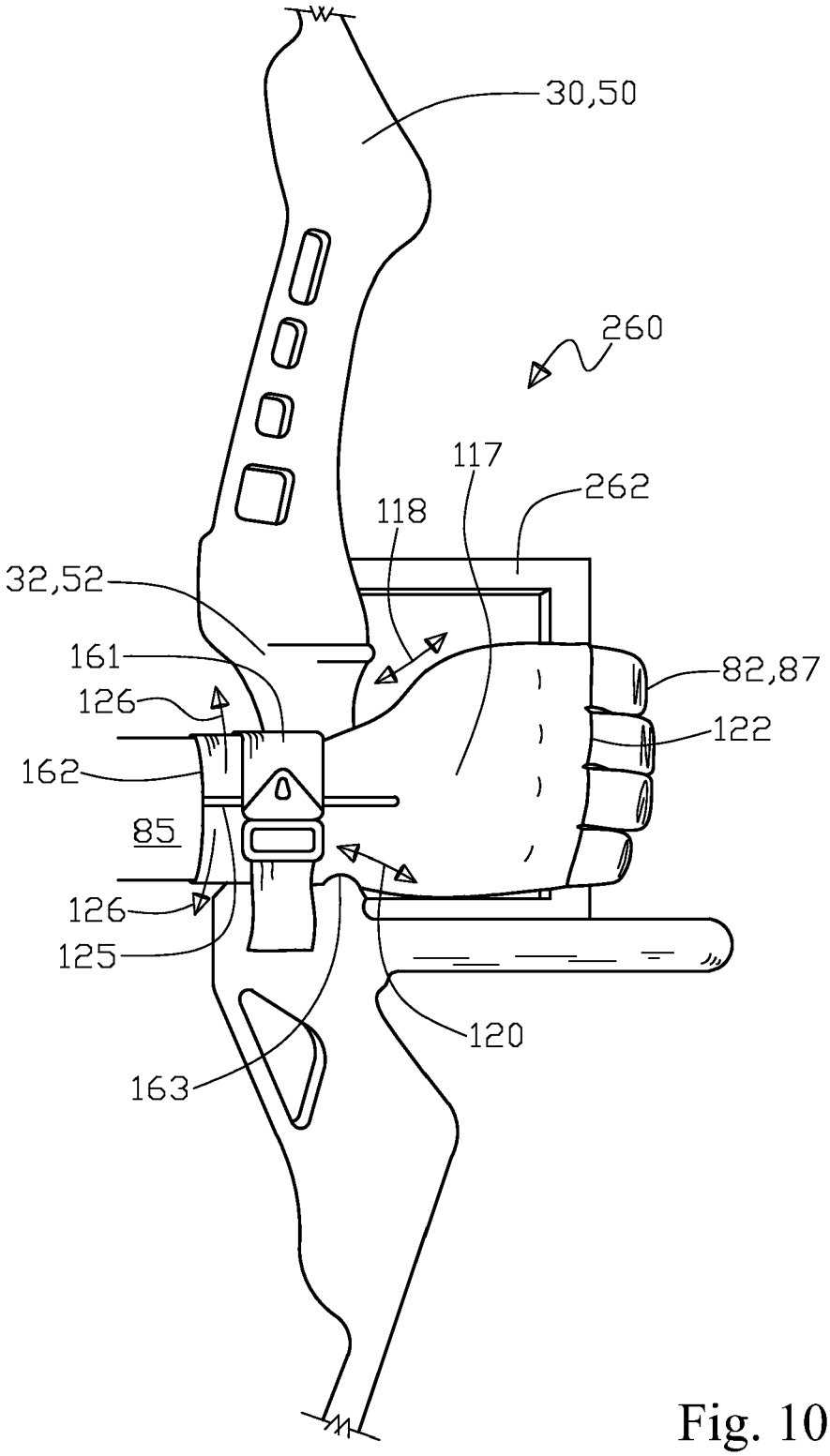
FIG. 10 is a use side view in elevation of the handle portion of the bow apparatus or the compound bow of FIGS. 1 and 2 illustrating a second exemplary embodiment of the present invention with the archers hand, thumb, fingers, and arm inserted into the rigid member that includes the retention strap, the wrist aperture, the finger apertures, the expansion slot, the flex relief aperture, and the higher and lower stiffness directions of the rigid member, wherein the rigid member is integral with the bow handle including the structural extension member forming the second exemplary embodiment of the present invention.
Figure 11:
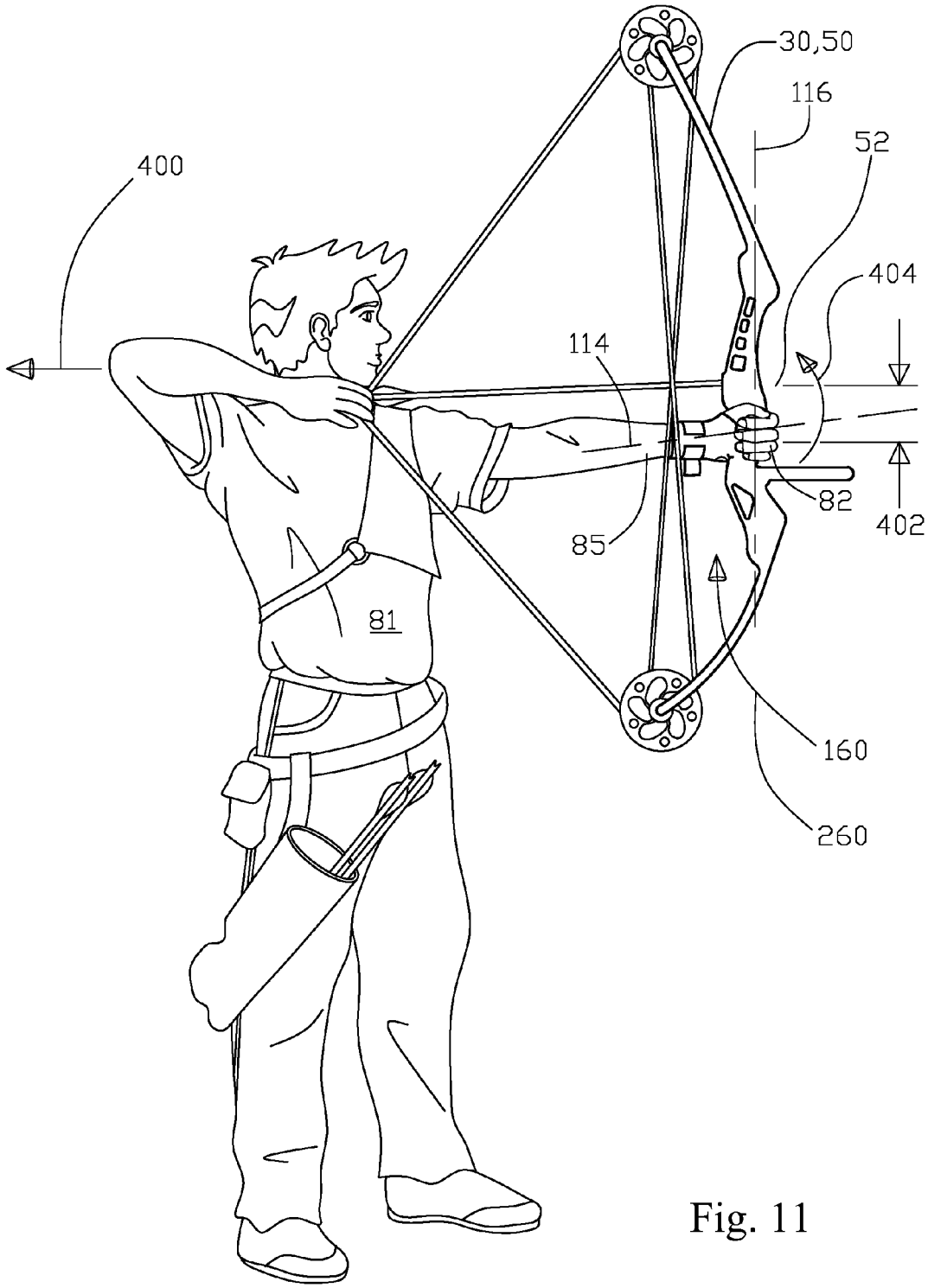
FIG. 11 is a side use view of the archer using a bow being either from FIG. 1 or 2, with the drawstring fully pulled, with the archer using the first exemplary embodiment of the present invention.
Figure 12:
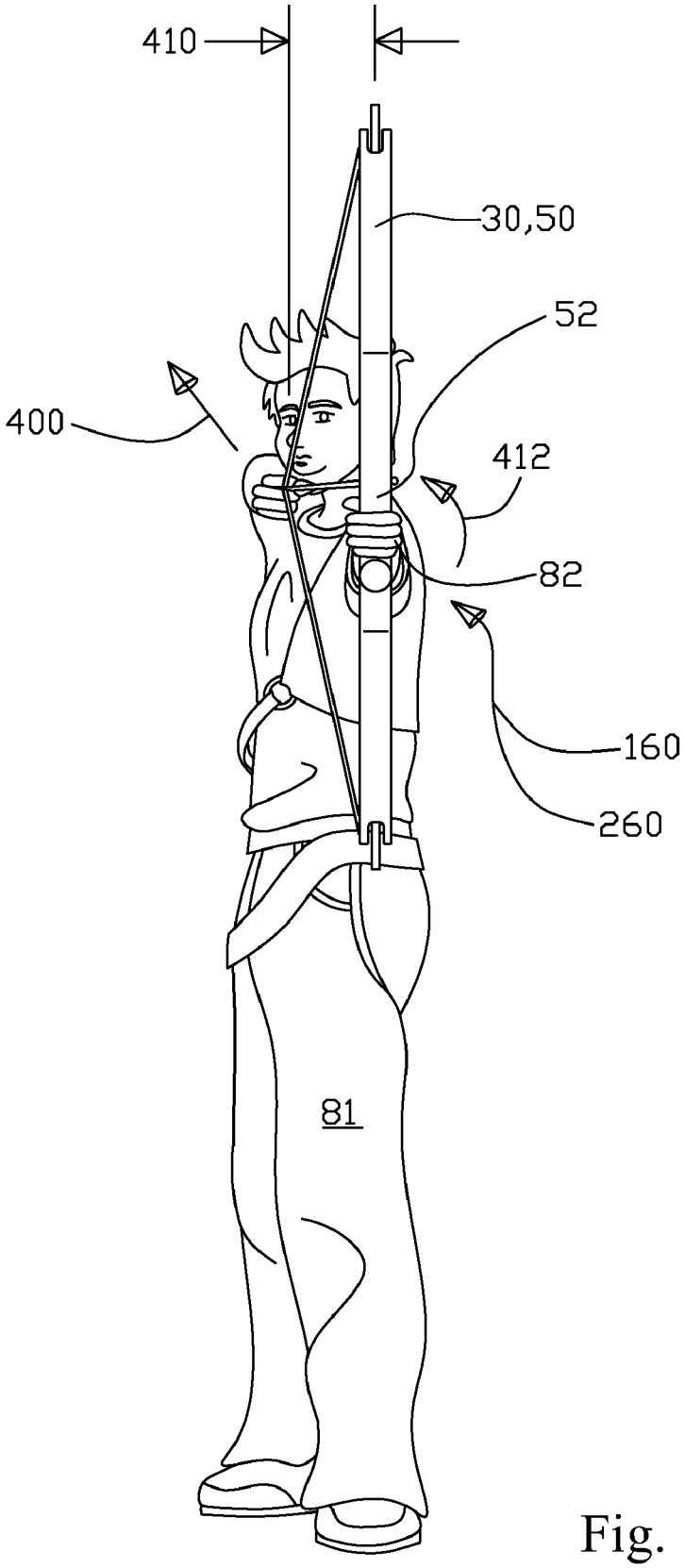
FIG. 12 is an end use view of the archer using a bow with the drawstring fully pulled, with the archer using the first exemplary embodiment of the present invention.

Continuing, FIG. 10 is a use side view in elevation of the handle portion 32, 52 respectively of the bow apparatus 30 or the compound bow 50 of FIGS. 1 and 2 illustrating a second exemplary embodiment 260 of the present invention with the archers 81 hand 82, thumb 83, fingers 87, and arm 85 inserted into the rigid member 117 that includes the retention strap 161, the wrist aperture 162, the finger apertures 122, the expansion slot 125, the flex relief aperture 163, and the higher 118 and lower 120 stiffness directions of the rigid member 117, wherein the rigid member 117 is integral with the bow handle 32, 52 including the structural extension member 262 forming the second exemplary embodiment 260 of the present invention. Moving onward, FIG. 11 is a side use view of the archer 81 using a bow 30 or 50 being either from FIG. 1 or 2, with the drawstring fully pulled, with the archer 81 using the first exemplary embodiment 160 of the present invention and FIG. 12 is an end use view of the archer 81 using a bow 30 or 50 with the drawstring fully pulled, with the archer 81 using the first exemplary embodiment 160 of the present invention.

Looking at particular to FIGS. 6 through 9, the archer's hand support structure apparatus or first exemplary embodiment 160 includes an archer's hand support structure apparatus to help stabilize an archer's 81 hand 82 during string 46, 70 draw and string 46, 70 release of an archer's bow 30, 50, and otherwise secure the archer's bow 30, 50 to the archer's 81 hand 82 support structure or first exemplary embodiment 160 without manually grasping, including the archer's bow 30, 50 that includes the handle portion 32, 52. Also included in the support structure apparatus 160, 260 is the rigid member 117 that is affixed to the handle portion 32, 52, the rigid member is constructed of a substantially non-pliant material that is adapted to encase the archer's 81 hand 82, the rigid member 117 having a finger aperture portion 122 extending adjacent to an archer's 81 distal hand portion 87 and a wrist aperture portion 162 extending adjacent to an archer's 81 proximal hand portion 85. The rigid member 117 also includes an expansion slot 125 therethrough disposed substantially adjacent to the wrist aperture portion 162 to temporarily expand 126 the wrist aperture portion 125 for operationally accommodating an archer's 81 fingers 87 communication from the wrist aperture 162 to the finger aperture 122.

Optionally, the archer's hand support apparatus 160 can further comprise a removably engagable retention strap 161 that is disposed adjacent to the expansion slot 125, wherein operationally the retention strap 161 helps limit the expansion slot 125 movement 126 to further secure the archer's 81 hand 82 within the rigid member 117.

Also, optionally the archer's hand support apparatus 160 the rigid member 117 can further comprise a flex relief aperture 163 therethrough that is disposed midway between the finger aperture 122 and the wrist aperture 162. Wherein operationally, the flex relief aperture 163 creates in the rigid member 117 a lower lateral stiffness direction 120 and an opposing higher lateral stiffness direction 118 for the purpose of enhancing the archer's 81 hand 82 comfort within the rigid member 117 during a bow string release 46, 70.

Referencing FIG. 10 in particular the archer's 81 hand 82 support structure apparatus being the second exemplary embodiment 260 to help stabilize an archer's 81 hand 82 during string 46, 70 draw and string 46, 70 release of an archer's bow 30, 50, includes the archer's bow 30, 50 that includes the structural extension member 262 and the rigid member 117. The rigid member 117 is adapted to grasp the structural extension member 262 and the rigid member 117 is constructed of substantially non-pliant material adapted to encase the archer's 81 hand 82, with the rigid member 117 having a finger aperture portion 122 extending adjacent to an archer's 81 distal hand portion 87 and a wrist aperture portion 162 extending adjacent to the archer's proximal hand portion 85. The rigid member 117 also includes an expansion slot 125 therethrough disposed substantially adjacent to the wrist aperture portion 162 to temporarily expand 126 the wrist aperture portion 162 for operationally accommodating an archer's 81 fingers 87 communication from the wrist aperture 162 to the finger aperture 122.

Optionally, the archer's hand support apparatus 260 can further comprise a removably engagable retention strap 161 that is disposed adjacent to the expansion slot 125, wherein operationally the retention strap 161 helps limit the expansion slot 125 movement 126 to further secure the archer's 81 hand 82 within the rigid member 117.

Also, optionally the archer's hand support apparatus 260 the rigid member 117 can further comprise a flex relief aperture 163 therethrough that is disposed midway between the finger aperture 122 and the wrist aperture 162. Wherein operationally, the flex relief aperture 163 creates in the rigid member 117 a lower lateral stiffness direction 120 and an opposing higher lateral stiffness direction 118 for the purpose of enhancing the archer's 81 hand 82 comfort within the rigid member 117 during a bow string release 46, 70.

Method of Use

With primary reference to use FIGS. 8 through 12, showing the usage of the first 160 and second 260 exemplary embodiments, wherein specifically FIG. 8 is a use side view in elevation of the handle portion 32, 52 respectively of the bow apparatus 30 or the compound bow 50 of FIGS. 1 and 2 illustrating a first exemplary embodiment 160 of the present invention with the archers 81 hand 82, thumb 83, fingers 87, and arm 85 inserted into the rigid member 117. Wherein the rigid member 117 includes the retention strap 161, the wrist aperture 162, the finger apertures 122, the expansion slot 125, the flex relief aperture 163, and the higher 118 and lower 120 stiffness directions of the rigid member 117, wherein the rigid member 117 is integral with the bow handle 32, 52 forming the first exemplary embodiment 160 of the present invention.

Continuing, FIG. 10 is a use side view in elevation of the handle portion 32, 52 respectively of the bow apparatus 30 or the compound bow 50 of FIGS. 1 and 2 illustrating a second exemplary embodiment 260 of the present invention with the archers 81 hand 82, thumb 83, fingers 87, and arm 85 inserted into the rigid member 117. Wherein the rigid member 117 includes the retention strap 161, the wrist aperture 162, the finger apertures 122, the expansion slot 125, the flex relief aperture 163, and the higher 118 and lower 120 stiffness directions of the rigid member 117, wherein the rigid member 117 is integral with the bow handle 32, 52 including the structural extension member 262 forming the second exemplary embodiment 260 of the present invention. Moving onward, FIG. 11 is a side use view of the archer 81 using a bow 30 or 50 being either from FIG. 1 or 2, with the drawstring fully pulled, with the archer 81 using the first exemplary embodiment 160 of the present invention and FIG. 12 is an end use view of the archer 81 using a bow 30 or 50 with the drawstring fully pulled, with the archer 81 using the first exemplary embodiment 160 of the present invention.

The method of using an archer's hand support 160 and 260 to help prevent undesirable movement through moments 404 and 412 upon an archer's hand 82 during string 46 or 70 draw force 400, see FIGS. 11 and 12, and the further subsequent release of the bow 30 or 50 comprises the steps of; firstly providing the present invention in an archer's hand support structure apparatus 160 or 260 to help stabilize an archer's 81 hand 82 during string 46 or 70 draw and string 46 or 70 release of an archer's bow 30 or 50. The archer's hand support structure apparatus 160 or 260 includes an archer's hand support structure apparatus to help stabilize an archer's 81 hand 82 during string 46, 70 draw and string 46, 70 release of an archer's bow 30, 50, and otherwise secure the archer's bow 30, 50 to the archer's 81 hand 82 support structure 160, 260 without manually grasping, including the archer's bow 30, 50 that includes the handle portion 32, 52.

Also included in the support structure apparatus 160, 260 is the rigid member 117 that is affixed to the handle portion 32, 52, the rigid member is constructed of a substantially non-pliant material that is adapted to encase the archer's 81 hand 82, the rigid member 117 having a finger aperture portion 122 extending adjacent to an archer's 81 distal hand portion 87 and a wrist aperture portion 162 extending adjacent to an archer's 81 proximal hand portion 85. The rigid member 117 also includes an expansion slot 125 therethrough disposed substantially adjacent to the wrist aperture portion 162 to temporarily expand 126 the wrist aperture portion 125 for operationally accommodating an archer's 81 fingers 87 communication from the wrist aperture 162 to the finger aperture 122.

A next step is in placing the archer's 81 hand 82 therethrough the rigid member 117 as best shown in FIGS. 8 through 12 via releasing the retention strap 161 and utilizing the expansion slot 125 to distend open to accommodate the hand 82 slipping within the rigid member 117 until the fingers 87 are fully disposed within the finger apertures 122, as shown in FIGS. 8, 9, and 10. A further step is to secure the retention strap 161 to retain the archer's 81 hand 82 within the rigid member 117, also as shown in FIGS. 8 and 10. Next, a further step of drawing through force 400 and releasing the bow string 46 and 70, as shown in FIGS. 11 and 12.

With the goal of the archer's hand support 160 or 260, looking in particular at FIGS. 11 and 12, being to help prevent the reduction in bow shooting accuracy from the inherent effects of the moment arm offsets 402 and 410 that come from the centroid of the pulling force 400 being at the intersection of the arrow and the bow string 46 and 70 thus resulting in the moment arm offsets 402 and 410 that are the offset distances from the centroid of the pulling force 400 and the archer's hand 82 grip on the bow handle 32 and 52. Due to the nature of typical bow 30 or 50 design, these offsets 402 and 410 being in conjunction with force 400 result in moments 404 and 412 that cause an un-symmetric load on the archer's hand 82, wherein the archer's hand 82 must compensate for this un-symmetric load in an opposing direction to the moments 404 and 412, wherein the present invention assists in the archer 81 in this un-symmetric load compensation by diffusing the load compensation over a greater area of the archer's 81 hand 82 and potentially the archer's arm 85 resulting in more archer's hand 82 stability and less fatigue upon the archer's hand 82.

Optionally, as shown in FIG. 10, the addition of the structural extension member 262 further adds the aforementioned stability as against moments 404 and 412 by having the archer 81 use their fingers 87 to grasp the structural extension member 262 without having the rigid member 117 integral with the handle 32 or 52.

CONCLUSION

Accordingly, the present invention has been described with some degree of particularity directed to the exemplary embodiments of the present invention. It should be appreciated, though, that the modifications or changes may be made to the exemplary embodiment of the present invention without departing from the inventive concepts contained herein.

The invention claimed is:

1. An archer's hand support structure apparatus to help stabilize an archer's hand during string draw and string release of an archer's bow, and otherwise secure the archer's bow to said archer's hand support structure without manually grasping, comprising:

(a) an archer's bow that includes a handle portion; and (b) a rigid member that is affixed to said handle portion, said rigid member is constructed of substantially non-pliant material adapted to encase the archer's hand, said rigid member having a finger aperture portion extending adjacent to an archer's distal hand portion and a wrist aperture portion extending adjacent to an archer's proximal hand portion, said rigid member also includes an expansion slot therethrough disposed substantially adjacent to said wrist aperture portion to temporarily expand said wrist aperture portion for operationally accommodating an archer's fingers communication from said wrist aperture to said finger aperture, wherein said rigid member further comprises a flex relief aperture therethrough that is disposed midway between said finger aperture and said wrist aperture, wherein operationally said flex relief aperture creates in said rigid member a lower lateral stiffness direction and an opposing higher lateral stiffness direction for the purpose of enhancing the archer's hand comfort within said rigid member during a bow string release.

2. An archer's hand support according to claim 1, further comprising a removably engagable retention strap that is disposed adjacent to said expansion slot, wherein operationally said retention strap helps limit said expansion slot movement to further secure the archers hand within said rigid member.

3. An archer's hand support structure apparatus to help stabilize an archer's hand during string draw and string release of an archer's bow, comprising:

(a) an archers bow that includes a structural extension member; and (b) a rigid member that is adapted to grasp said structural extension member, said rigid member is constructed of substantially non-pliant material adapted to encase the archer's hand, said rigid member having a finger aperture portion extending adjacent to an archer's distal hand portion and a wrist aperture portion extending adjacent to an archer's proximal hand portion, said rigid member also includes an expansion slot therethrough disposed substantially adjacent to said wrist aperture portion to temporarily expand said wrist aperture portion for operationally accommodating an archers fingers communication from said wrist aperture to said finger aperture, wherein said rigid member further comprises a flex relief aperture therethrough that is disposed midway between said finger aperture and said wrist aperture, wherein operationally said flex relief aperture creates in said rigid member a lower lateral stiffness direction and an opposing higher lateral stiffness direction for the purpose of enhancing the archers hand comfort within said rigid member during a bow string release.

4. An archer's hand support according to claim 3, further comprising a removably engagable retention strap that is disposed adjacent to said expansion slot, wherein operationally said retention strap helps limit said expansion slot movement to further secure the archers hand within said rigid member.

* * * * *